US005107930A

United States Patent [19]

Hopper

[11] Patent Number: 5,107,930

[45] Date of Patent: Apr. 28, 1992

[54] GUIDE LINE ATTACHMENT

[75] Inventor: Hans P. Hopper, Aberdeen, Scotland

[73] Assignee: The British Petroleum Company p.l.c., London, England

[21] Appl. No.: 540,716

[22] Filed: Jun. 20, 1990

[30] Foreign Application Priority Data

Jun. 29, 1989 [GB] United Kingdom ..... 8914992

[51] Int. Cl.[5] ..... E21B 7/128; E21B 41/00; F16L 37/20; F16L 37/22

[52] U.S. Cl. ..... 166/342; 285/316; 403/109; 403/322; 405/191; 405/224

[58] Field of Search ..... 166/342, 349, 340; 403/322, 109; 285/316; 405/191, 224; 294/86.17, 86.25, 86.3, 86.33

[56] References Cited

U.S. PATENT DOCUMENTS

| | | | |
|---|---|---|---|
| 3,452,815 | 7/1969 | Watkins | 166/344 |
| 3,863,961 | 2/1975 | Dinning | 403/322 X |
| 4,032,240 | 6/1977 | Reinhardt et al. | 403/322 X |
| 4,405,263 | 9/1983 | Hall | 166/342 X |
| 4,443,130 | 4/1984 | Hall | 166/342 X |
| 4,708,524 | 11/1987 | Goris | 403/322 X |
| 4,828,035 | 5/1989 | McInturff | 403/322 X |
| 4,927,295 | 5/1990 | Knowles | 166/349 X |

FOREIGN PATENT DOCUMENTS

| | | |
|---|---|---|
| 1183082 | 3/1970 | United Kingdom . |
| 1186160 | 4/1970 | United Kingdom . |
| 2192240 | 12/1987 | United Kingdom . |
| 2225798 | 6/1990 | United Kingdom . |

*Primary Examiner*—Stephen J. Novosad
*Attorney, Agent, or Firm*—Larry W. Evans; Joseph G. Curatolo; Scott A. McCollister

[57] ABSTRACT

A guide line attachment for releasably attaching a guide line to a guide post top or other portion of a sub-sea installation has three relatively movable spring loaded concentric sleeves, the relative movement of which can be used to releasably lock the attachment to the guide post top or other portion. Relative movement of the sleeves also activates a latch to releasably lock the sleeves to each other. The attachment may fit inside or outside a guide post top and may be pre-set so that it will or will not automatically relatch on release. The guide post tops have internal or external grooves for engaging the attachment locking means, and specially designed tools may be used to effect remote release sub-sea. The guide line attachment may be used for all stages of the drilling and production of a sub-sea oil well and avoids the present need to cut and replace guide lines at different stages in the life of a sub-sea well.

12 Claims, 10 Drawing Sheets

78
17
17A
20
17B
16A
16
12
15
19
21
18
60
14
13

GUIDE LINE ATTACHMENT

This invention relates to an attachment for releasably attaching a guide line to a guide post top or to any other portion of a subsea installation. It includes a suitable guide post top for use with the attachment and suitable release tools.

Guide lines are used to establish a path for equipment being lowered from a surface vessel to an installation on the sea bed. In the past, guide lines have been attached to the equipment prior to running and cut when the operation had been completed. The guide line attachment and the guide post top or other part to which the line is attached have, therefore, been designed for manual assembly, with manufacturers supplying systems of varying degrees of complication. Removal of a guide line from such systems naturally presents difficulties. It has to be cut using divers, a drill pipe tool or an ROV leaving a tail of cut guide line. Alternatively, "shear out" release mechanisms can be used. Although simpler, these systems are unpredictable. Sometimes excessive forces are required to effect the shearing; sometimes they fail prematurely when subjected to an unexpected early shock load. Re-establishment can be affected by divers or by relatch mechanisms run on drill pipe. Such latch mechanisms have to be energised on the surface vessel so that engagement with the guide post top results automatically from the triggering of the lock mechanism.

All the systems require the post top to be slotted and accessible for insertion of the guide lines into the module prior to running from the surface vessel.

With the expanding potential use of sub sea production installations, there is a need for a system that is suitable for use with sub seal well trees, adaptable for work over operations and capable of operation by a ROV. At present, after a tree removal operation, up to 12 hours diving time may be required for removing the existing cut guide line tails and re-establishing new guide lines. For sub sea installations below diver depth, guide line installation and removal are even more awkward and time consuming.

The present invention is concerned with a guide line attachment that is readily releasable and which can be used for all stages of the life of a sub sea well and not merely its drilling stage. It can thus be used for drilling, for completion, for work over and for wire line intervention. The invention includes associated guide post tops or other attachment points and release tools.

In addition, the attachments have the capability of being combined with a heave compensation system allowing running operations to proceed even in rough weather. They can also be used on multi-well templates, the guide lines being simply released when operations on one well are complete, and transferred to another well.

According to the present invention, a guide line attachment for attaching a guide line to a guide post top or other portion of a sub sea installation comprises:

(a) three concentric sleeves surrounding the end of a guide line, each sleeve being capable of relative movement along the axis of the guide line, (b) springs between and stops on the sleeves to control the relative movement, (c) means actuated by relative movement of the sleeves to lock the attachment into a guide post top or other part, and (d) a latch to releasably lock the sleeves when the guide line is tensioned and prevent relative axial movement of the sleeves.

The attachment may be either an internal attachment designed to lock inside the top of a guide post or other portion or an external attachment designed to lock onto the outside of a guide post top. The guide posts and guide post tops are slotted to allow the guide line to be installed. The guide line slot in the guide post top then has to be closed after the guide line has been inserted, and the present invention includes a guide post top with a simple segment held by a lock screw to close the slot.

In sub sea installations there may be a series of modules placed one on top of each other, each module having guide posts, which fit over the top of each other. Thus, a sub sea well may have three modules superposed in this way, e.g. a permanent guide base at the bottom, then a well tree, and then a work over blow out preventer stack with an emergency disconnect package.

The guide wire attachment may thus have to pass through a number of guide post tops and be capable of being attached to any of these tops, or capable of passing through any of these tops for attachment to another top. Similarly, on release of a guide line from a lower post top, it must be capable of being withdrawn through the upper post tops without relatching to them.

To allow a guide line attachment to be withdrawn without relatching the attachment can be put in a "locked release mode" (i.e. with the latching system locked in the release position). This mode can be pre-set on a surface vessel before the guide line is run.

The guide posts in a multi-post system may have windows in the upper posts on a level with the enclosed lower guide post top, so that the lower guide post top and guide line attachment on its is accessible to a ROV for release.

The guide line attachment of the present invention may also be used with single guide posts, a particular benefit being, as previously explained, that the releasable attachments can simply be transferred from one well slot of a multi well template to another. For example, a drilling BOP or workover BOP could be released and raised up to clear the template (say 50 feet). The guide lines would then be transferred by an ROV to the new slot. Finally the BOP would be moved the required distance sideways and lowered again.

With this mode of operation, the latching system has to be released in the "re-latching mode" so that it re-latches on contacting another guide post top. Again, this mode can be pre-set on a surface vessel before use.

With internal attachments, the hollow guide posts and guide post tops are of a uniform internal diameter, so that the internal attachments can be lowered, if necessary, right through a guide post. This internal diameter must obviously be at least equivalent to the outside diameter of the internal attachment (as distinct from present designs which close off the bore to that of the guide line diameter).

The above description applies to an internal attachment. The same basic principle can, however, be adapted as an external attachment, latching onto the exterior of a guide post top or other portion of a sub sea installation. An exterior attachment can be used generally as required but is particularly suitable for use if an internal latch attachment has become damaged or stuck. An external latch attachment can be lowered, latched to a guide post top and locked to lift the module with the damaged or stuck internal attachment. With an external latch the sleeves surrounding the guide line must obviously extend beyond the end of the guide line itself to form a hollow assembly capable of fitting over the guide post top.

The weakest point of a guide line system is the guide line itself just above the guide post and attachment, since this is most susceptible to fatigue or shearing damage. The system of the present invention, using guide posts of a consistent, relatively large, internal diameter, allows larger diameter, stronger guide line cable to be used adjacent to the attachment. This larger diameter cable can be joined to normal diameter cable by a suitable tie joint at a suitable distance above the attachment (e.g. 50 to 100 feet).

Such a composite guide line is the subject of a separate UK Application No. 9013118.6 entitled Composite Guide Line.

The attachments are locked into guide post tops or other portions simply by an upward pull on the guide line. They can be released either by a downward force from a dropped weight or by an upward pull of a ROV on one of the sleeves.

Suitable tools lowered from the surface on drill pipe or line or actuated by a ROV can be used for release and such tools are included as part of the present invention.

The invention is illustrated with reference to the accompanying drawings in which.

Figure 1:
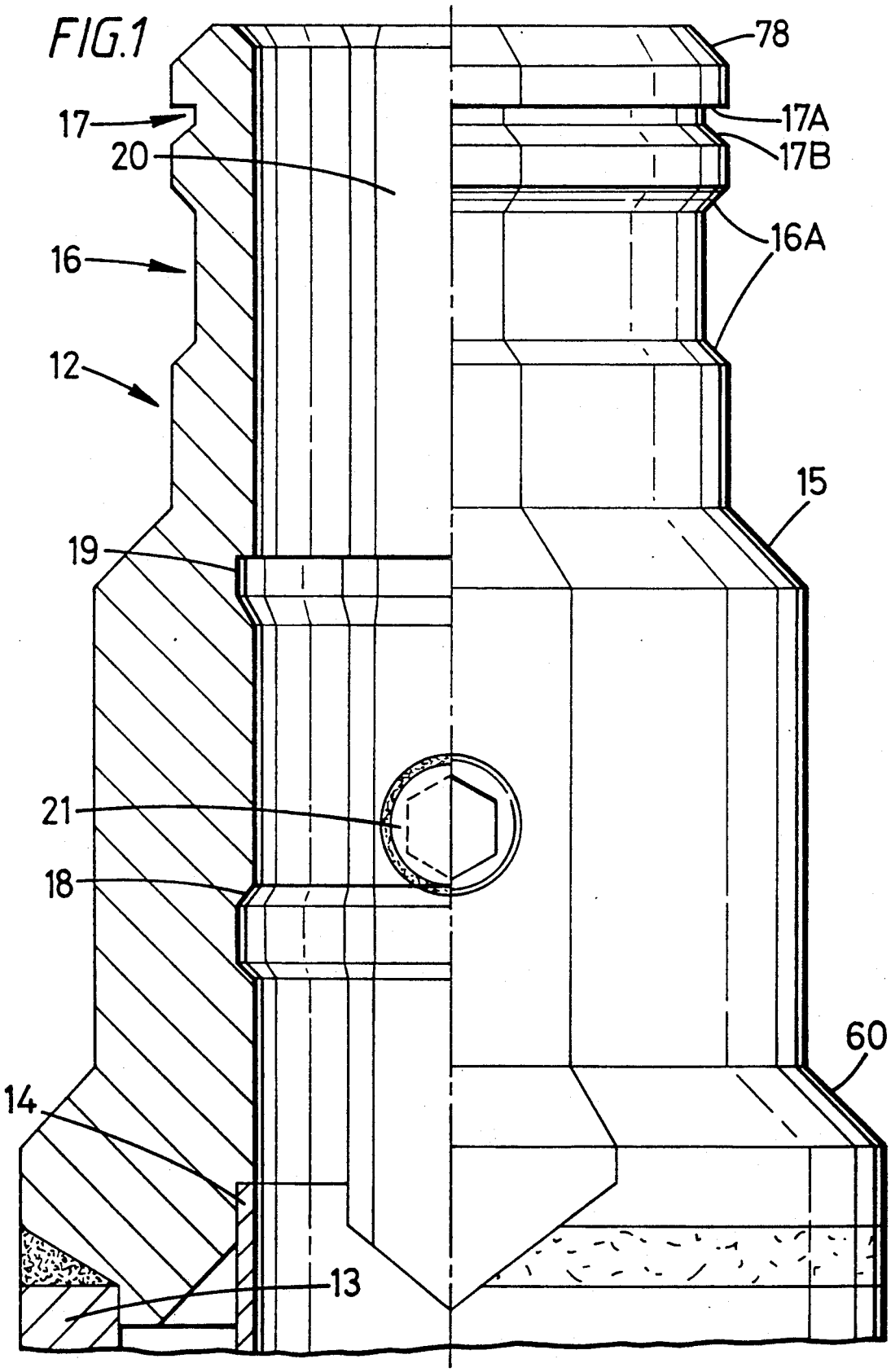
FIGS. 1 and 2 are, respectively, a half-sectioned elevation of a guide post top and a partially sectioned plan of it.

FIG. 1 shows a guide post top, the right hand side of the centre line being an elevation and the left hand side being a section at 180° to the right hand side elevation. The guide post top, indicated generally at 12, is welded to a guide post 13, which has a constant diameter liner 14 extending down through it. The external contour of the guide post top has a guide shoulder 15, an external load groove 16 with angled (e.g. 45°) top and bottom faces 16A and an external lock groove 17 the top face 17A of which is at 90° to the longitudinal axis of the post. The bottom face 17B of lock groove 17 is angled at e.g. 45°.

The hollow interior of the guide post top has internal load and lock grooves similar to the external grooves, i.e. internal load groove 18, with angled (e.g. 45°) top and bottom faces and internal lock groove 19 with a 90° top face and an angled (e.g. 45°) bottom face.

In addition to the midpoint guide shoulder 15, guide post top 12 has a further suitably angled shoulder 60 at its base. Its top 78 is also chamfered at a suitable angle (e.g. 45°). Chamfered top 78 and guide shoulder 15 provide guidance for an external attachment as it is lowered over the guide post top, giving a first coarse guidance and then a finer one.

The normal longitudinal guide wire slot 73 of the guide post top is closed with an insert segment 20 having a lock screw 21.

Figure 2:
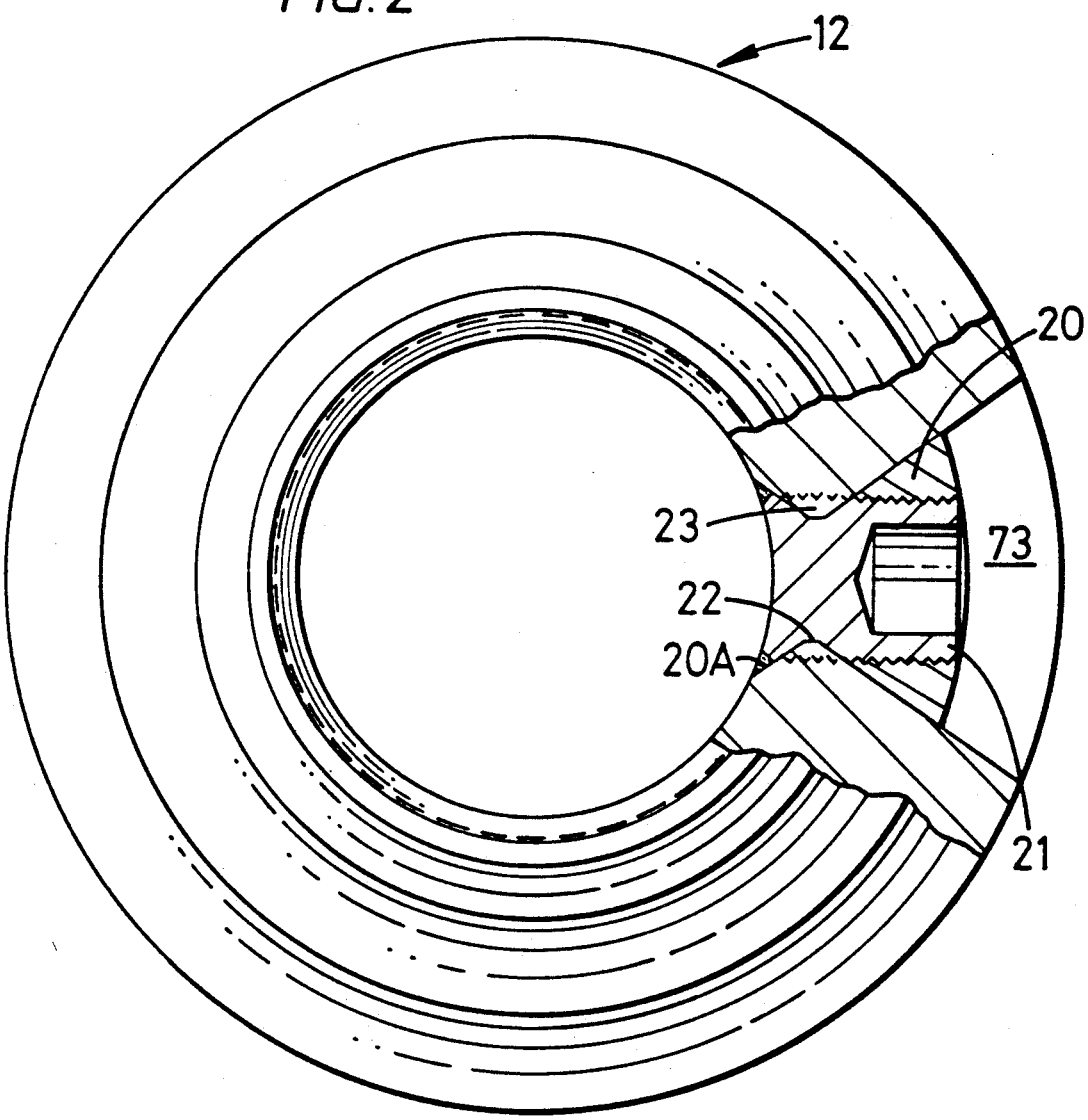

The guide post plan view of FIG. 2 shows the segment 20 more clearly. The guide wire slot sides are angled with apices 22 and the segment has a corresponding contour so that the segment and slot can be considered as a dove tail. The segment can be inserted simply by pushing it down into the top of the slot. Apices 22 are machined away to form arcs 23 at the level where lock screw 21 will be when the segment is fully inserted. Screw 21 can thus be screwed into the segment 20 until it enters the circular hole formed by machining away the apices and holds the segment 20 firmly in place against the segment seat 20A.

This simple but effective way of closing the guide slot of a guide post top is particularly suitable for use with the present invention, but could have general utility for the guide posts of sub sea installations, irrespective of the type of guide line attachments used.

Figure 3:
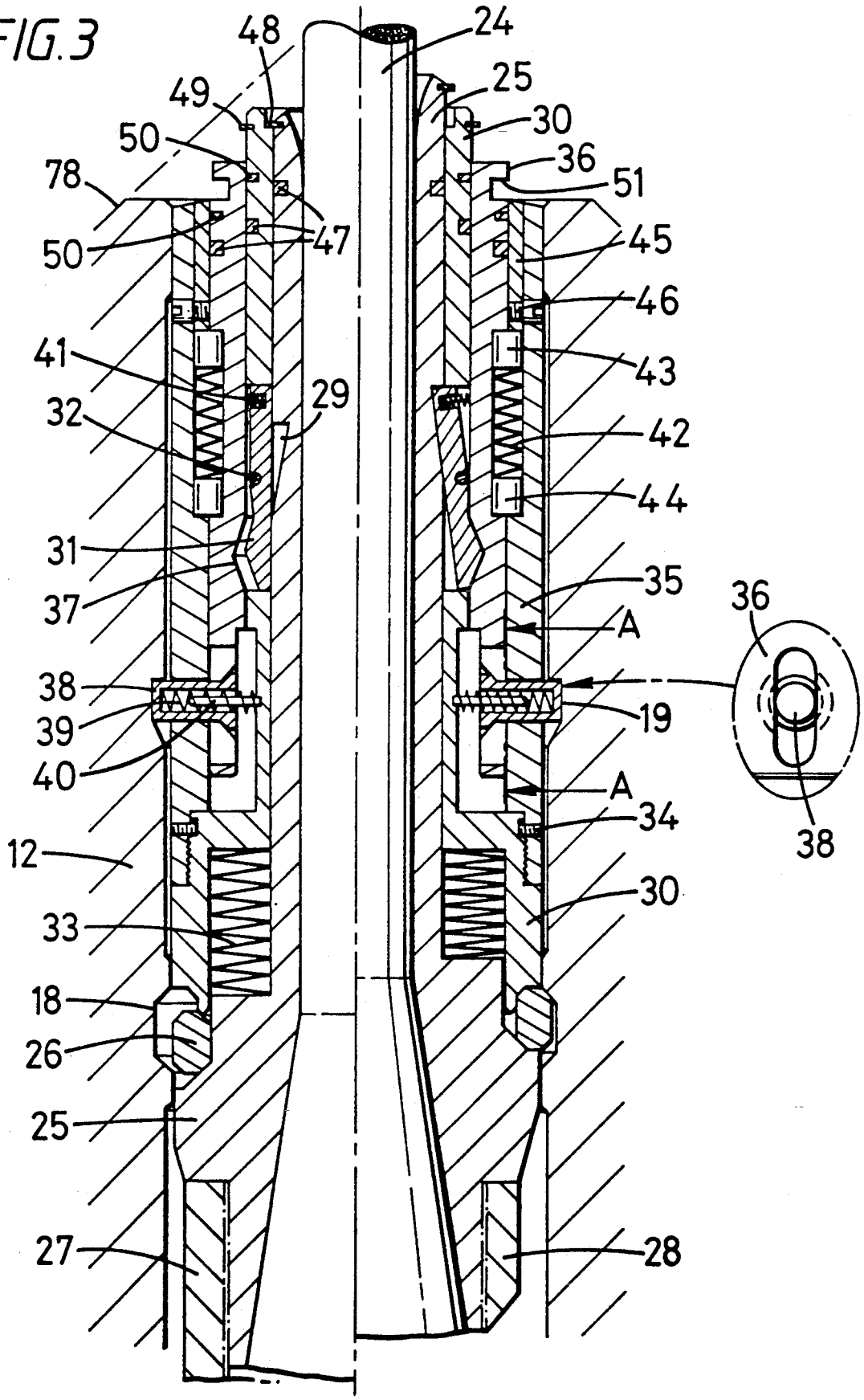
FIG. 3 is an internal attachment according to the present invention.

FIG. 3 shows an internal guide line attachment within a guide post top 12 with its internal load groove 18 and lock groove 19. The left hand side of the centre line shows the attachment within the guide post top and partially locked into it; the right hand side of the centre line shows the attachment fully locked in.

The attachment surrounds the end of guide line 24. Immediately surrounding guide line 24 is line sleeve 25, which widens out at its base to support load ring 26. A sinker bar 27 may be screw threaded to the end of line sleeve 25 to give weight to the attachment if required (see left hand side of FIG. 3). If not required, the thread may be protected by thread protector 28 (See right hand side of FIG. 3). Line sleeve 25 has a circular groove 29 on its exterior for trigger dogs 31 (see below). In section, groove 29 is notch shaped. Being a circular groove there is no need for orientation of the line sleeve 25 relative to trigger dogs 31.

Outside line sleeve 25 is inner housing sleeve 30. Within hollowed out portions of inner housing sleeve 30 are a number of trigger dogs 31. These fit around pins 32 so that they can rock about pins 32 as if they were hinged. The tops of the trigger dogs 31 have small springs 41 inserted into them tending to rock the dogs about pins 32. Below trigger dogs 31 inner housing sleeve 30 turns through two right angles to terminate above load ring 26. Spaces formed between line sleeve 25 and inner housing sleeve 30 contain reset springs 33 tending to force inner housing sleeve 30 up relative to line sleeve 25. Screwed to inner housing sleeve 30 and held by lock screws 34 is outer housing sleeve 35.

Between inner housing sleeve 30 and outer housing sleeve 35 is another sleeve, trigger sleeve 36. On its interior it has a circular groove 37 having a V-shaped cross-section adjacent the bottom of trigger dogs 31. Again, the use of a circular groove 37 means that no orientation is required between trigger sleeve 36 and trigger dogs 31. At the bottom of trigger sleeve 36 are a number of chamfered holes. Lock pins 38 which are internally spring loaded by springs 39 pass through these holes and through corresponding holes in outer housing sleeve 35 into lock groove 19 of the guide post top. The inner ends of lock pins 38 are chamfered correspondingly to the chamfered holes through the trigger sleeve 36. Lock pins 38 are floating, but are held by the springs 39 which are placed over location pins 40 secured to inner housing sleeve 30.

Spaces formed between trigger sleeve 36 and outer housing sleeve 35 enclose bias springs 42 held between upper and lower rings 43 and 44. Above these spaces, a housing lock sleeve 45 is held by screws 46 onto the inside of outer housing sleeve 35 to close the gap between outer housing sleeve 35 and trigger sleeve 36.

Locking and release operations from the attachment are performed by relative movement between the three sleeves 25, 30 and 36 as will be described hereafter. Each sleeve, therefore has a ring seal 47 to prevent ingress of silt or small particles that would harm the sleeves. Line sleeve 25 has a circlip 48 at its top to limit its downward movement relative to inner housing sleeve 30 and inner housing sleeve 30 has a circlip 49 to limit upward movement of trigger sleeve 36 relative to it. The top of trigger sleeve 36 has a latch profile 51 so that it can, if required, be gripped and pulled upwardly.

Line sleeve 30 and trigger sleeve 36 also have rings 50 near their tops. Rings 50 are used to put the attachment into either the "locked release mode" or the "relatchable mode". As previously explained, the mode can be predetermined on the surface vessel. If the rings 50 fitted are outwardly biassed spring rings, then the attachment will be in the locked release mode. If the rings 50 are simple inert filler rings with no spring bias then the attachment will be in the relatchable mode. The various modes and how the rings 50 define them will be described hereafter with reference to the operation of the internal attachment of FIG. 3.

FIG. 3 shows the chamfered edge 78 of guide post top 12. If other modules or guide posts are superimposed on the guide post top, they rest on this edge and have to be designed to do so. If they do, the dotted line extending up from edge 78 shows that this superimposed equipment will clear the top of the internal attachment and cannot, therefore, strike or damage it.

In a latching operation, a guide line with its internal attachment is lowered with the sleeves in the positions shown on the left hand side of FIG. 3. It will be seen that load ring 26 and all other parts (except lock pins 38) are positioned so that the attachment will pass into a guide post top. Springs 39 of lock pins 38 tend to push the pins outwardly but since they are floating pins, they will be pushed inwardly as soon as the attachment enters the guide post top. When however the attachment has entered as far as the position shown on the left hand side of FIG. 3 lock pin 38 enters lock groove 19 of the guide post top. The 90° top face of groove 19 holds the pin firmly against upward pressure (accidental further downward movement of the attachment is possible and not detrimental, however, because the bottom face of groove 19 is angled at 45°). This means that the attachment can pass right through a guide post top and guide post, if required, for latching onto a lower guide post top. It also means that a slight overshoot within the guide post top to which the attachment is to be latched is not detrimental either.

Pin 38 thus holds outer housing sleeve 35, trigger sleeve 36 and inner housing sleeve 30 into the guide post top against any upward movement. However, line sleeve 25 and the guide line 24 are not so held. An upward pull on guide line 24 thus moves it and line sleeve 25 up a short distance relative to the other sleeves and the guide post top until groove 29 reaches the top of trigger dogs 31. Springs 41 of trigger dogs 31 push the tops into the groove 29 rocking the dogs slightly around pins 32 and pushing the bottoms of trigger dogs 31 into the groove 37 of trigger sleeve 36. The upward movement of line sleeve 25 also causes its lower part to bear against load ring 26 forcing it outwardly into load groove 18 of the guide post top. Reset springs 33 are compressed during this movement. The parts are now in the positions shown on the right hand side of FIG. 3 with all parts of the attachment locked together and with the attachment locked into the guide post top.

The attachment is clearly locked against upward tension on the guide line, but it is also locked if tension is relaxed or downward pressure is applied. Compressed reset springs 33 will be acting to try and push down line sleeve 25, but such movement is prevented by trigger dogs 31 in groove 29 of the line sleeve 25.

Positive action is thus required to release the attachment. The release action is effected by moving trigger sleeve 36 either downwardly (e.g. by use of a weight) or upwardly (e.g. by a ROV tool gripping latch profile 51 of the sleeve 36).

Either downward or upward movement causes the chamfered profiles of trigger sleeve 36 around the chamfered lock pins 38 to move the pins inwardly thereby freeing the pins from lock grooves 19 and withdrawing them into outer housing sleeve 35. This freeing can be affected with a relatively small movement of trigger sleeve 36. Movement of trigger sleeve 36 also starts to rock trigger dogs 31 as groove 37 rides up or down over the bottoms of the dogs. Only half of the rocking movement is completed, however, when the lock pins 38 are freed. An equivalent further movement is required to rock the trigger dogs 31 back until they are parallel with line sleeve 25 and the tops of the dogs are freed from groove 29 of the line sleeve.

Once the trigger dogs 31 are freed from the grooves, inner housing sleeve 30 and the other outer sleeves can move relative to line sleeve 25 under the force of the compressed reset springs 33. This upward force of compressed reset springs 33 will be effective, irrespective of whether trigger sleeve 36 is moved upwardly or downwardly to free trigger dogs 31.

To ensure that the force of compressed reset springs 33 acts to move inner housing sleeve 30 and the outer sleeves upwardly rather than to move line sleeve 25 downwardly, upward tension is maintained on guide line 24. The tops of trigger dogs 31 are thus moved above groove 29 and cannot be relocked by an upward pull. The upward movement of inner housing sleeve 30 also means that load ring 26 is no longer forced into load groove 18 and springs back to be free of the groove.

Thus, the attachment is now quite free and can be pulled out of the guide post top by pulling up on the guide line.

Upward or downward movement of trigger sleeve 36 is effected against the force of bias spring 42. As shown in FIG. 3, bias spring 42 is at its neutral point and trigger sleeve 36 in its neutral normal position. Downward movement of sleeve 36 will, however, through upper ring 43, compress bias spring 42. Similarly, upward movement of sleeve 36 will compress the spring through lower ring 44.

With release of pressure on sleeve 36, therefore, bias spring 42 will tend to restore trigger sleeve 36 to its neutral position. Whether it can do so or not depends on the choice of rings 50 fitted on the surface vessel before deployment of the attachment.

It will be seen that downward movement of trigger sleeve 36 will bring its top below the level of ring 50 in inner housing sleeve 30. Upward movement will bring ring 50 in trigger sleeve 36 above the top of housing lock sleeve 45.

If rings 50 are inert filler rings with no spring bias they will stay in their grooves and will not impede bias spring 42 from restoring trigger sleeve 36 to its neutral position after removal of pressure from the sleeve. The attachment is thus freed in its "relatchable mode" (i.e. with all parts back to their neutral positions so that the attachment will automatically relatch when it is moved into another guide post top).

If rings 50 are, however, outwardly biassed spring rings they will move out of their grooves when free to do so by the movement of trigger sleeve 36 and will prevent the sleeve from returning to its neutral position. Trigger sleeve 36 will thus hold lock pins 38 in. Load ring 26 will also remain free. This is the "locked release mode" which means that the attachment will not relock if it moves into another guide post top or has to pass through other post tops after it has been released.

Figure 6:
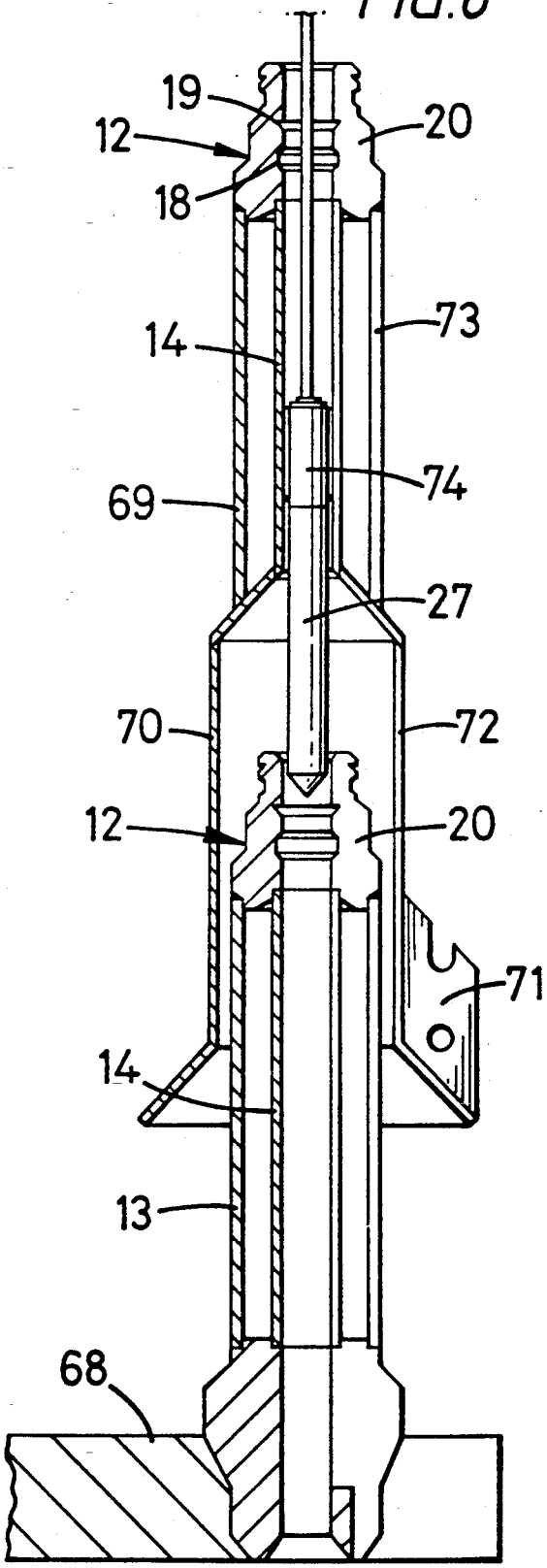
FIG. 6 is a section through two superimposed guide posts.

As previously explained, the internal attachment may be used with a number of superimposed guide posts and FIG. 6 shows such a use. If an attachment is freed from a lower guide post top it has to pass up through one or more upper guide post tops. If in the "locked release mode" it will do so. If in the relatchable mode it will lock into the next guide post top.

FIG. 3 shows the use of a rocking latch (i.e. trigger dogs 31 cooperating with groove 29 of line sleeve 25) to releasably lock the sleeves. However, other forms of non-rocking latch could be used. Thus a second set of spring loaded lock pins similar to lock pins 38 could replace rocking trigger dogs 31, these lock pins cooperating with a groove in line sleeve 25 having the same profile as groove 19 of guide post top 12 (i.e. a 90° top face and angled bottom face). This second set of spring loaded lock pins could be moved into and out of their appropriate groove by the same type of chamfered hole in trigger sleeve 36 as is used to move lock pins 38.

Similarly, although the means for locking the attachment into the guide post top or other portion is shown in FIG. 3 as load ring 26 fitting into groove 18, it will be appreciated that other known means of locking could be used, e.g. load pins or locking dogs, the only requirement being that the locking means is moved into locking engagement by an upward pull on guide line 24 and is released by upward or downward movement of trigger sleeve 36.

Figure 4:
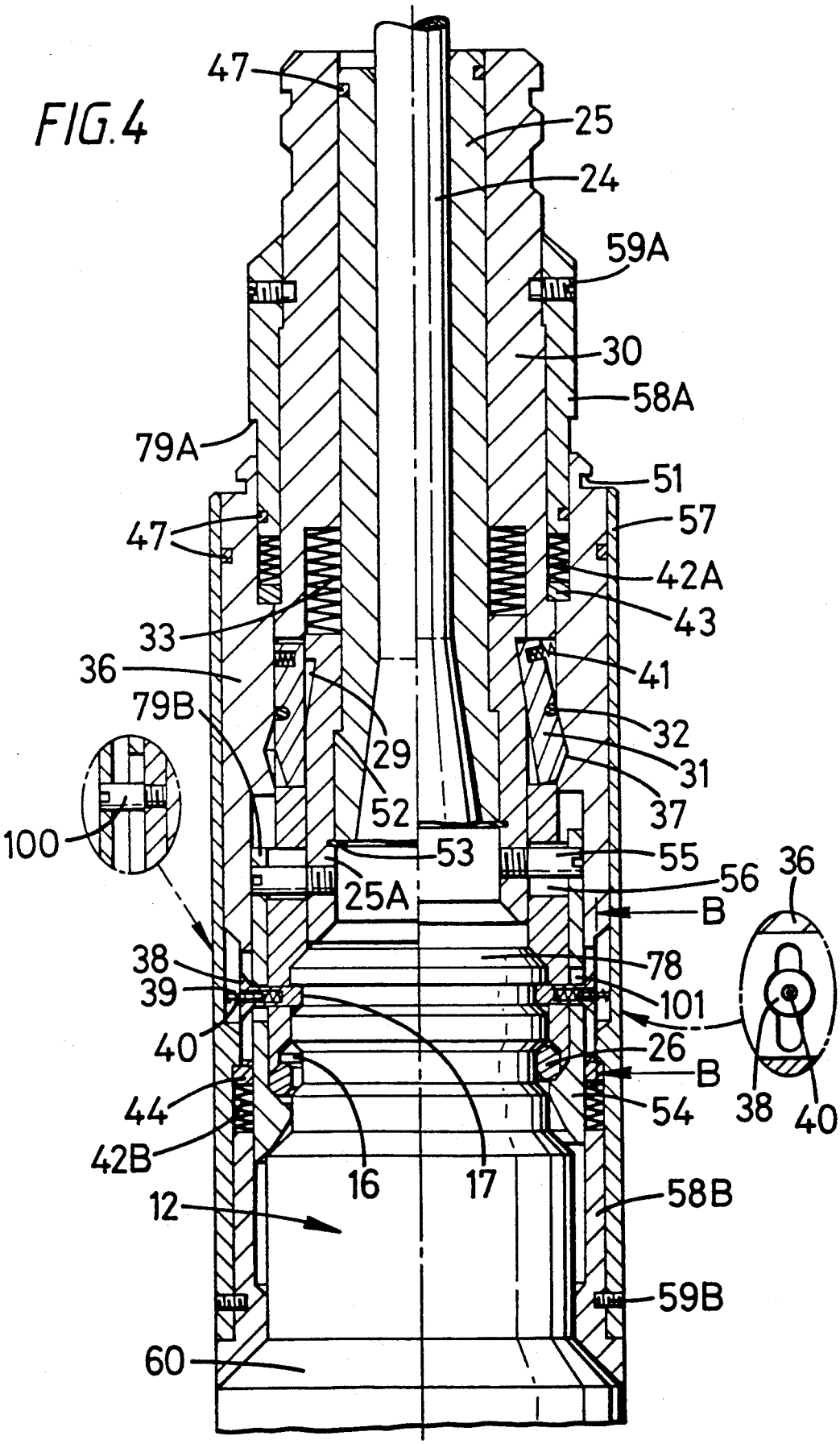
FIG. 4 is an external attachment according to the present invention.

FIG 4 shows an external guide line attachment capable of fitting over the outside of a guide post top 12 with its external load groove 16 and lock groove 17.

The parts of the attachment and its operation are essentially the same as the internal attachment of FIG. 3 and, where appropriate, the same reference numerals have been used. As with FIG. 3, the left hand side of the drawing shows the attachment landed on a guide post top but not fully locked and the right hand side shows the fully locked attachment.

FIG. 4 shows guide line 24 surrounded by line sleeve 25. As with FIG. 3, line sleeve 25 supports load ring 26, but, as an external attachment, the support is through an extension of line sleeve 25 extending beyond guide line 24. To this end line sleeve 25 has an extension 25A held to the sleeve itself by a shoulder 52 and circlip 53. This extension 25A has a notch-shaped groove 29 adjacent to trigger dog 31. Extension 25A is, in turn, fixed to latch sleeve 54 (which supports the load ring 26) by transition pins 55. These pins pass through slots 56 in inner housing sleeve 30, which surrounds line sleeve 25 and extends down to just above load ring 26. Holes 56 in inner housing sleeve 30 are large enough to allow relative movement between line sleeve 25 and inner housing sleeve 30 for the locking operation.

Between line sleeve 25 and inner housing sleeve 30 are reset springs 33. Inner housing sleeve also houses trigger dogs 31 hinged on pins 32 and having springs 41.

Outside inner housing sleeve 30 is trigger sleeve 36 with its notches 37 adjacent trigger dogs 31 and with a latch profile at its top.

The external attachment of FIG. 4 has similar lock pins 38 with internal springs 39 fitting over pins 40 as the internal attachment of FIG. 3. The pins are, however, modified to move inwardly into lock groove 17 of the guide post top. To this end, pins 40 are secured to the inside of housing outer sleeve 57. Pins 38 are floating but are located by the chamfered holes of trigger sleeve 36 cooperating with the chamfered heads of the pins 38. Pins 38 pass through holes 101 in latch sleeve 54 and inner housing sleeve 30 to reach lock groove 17, holes 101 through latch sleeve 54 being wide enough to allow for upward or downward movement of the sleeve for locking.

The housings for the external attachment differ somewhat from the internal attachment of FIG. 3 with the single bias spring 42 of FIG. 3 being replaced by two springs. Thus, housing profile sleeve 58A is screwed by screws 59A to inner housing sleeve 30, with upper bias springs 42A and bias rings 43 in the spaces below it. There is a further housing profile sleeve 58B near the bottom of the attachment screwed by screws 59B to housing outer sleeve 57, this lower housing profile sleeve enclosing lower bias springs 42B and lower bias rings 44.

As in FIG. 3, there are seals 47 in line sleeve 25, housing profile sleeve 58A (in effect a part of inner housing sleeve 30) and trigger sleeve 36, to prevent silt or small particles getting between these relatively moveable sleeves.

Relative movement between line sleeve 25 (which is fixed to sleeve 25A) and inner housing sleeve 30 is limited by the travel of transition pins 55 in slots 56. Relative movement of trigger sleeve 36 is limited upwardly by shoulder 79A on housing profile sleeve 58A, and downwardly by shoulder 79B on inner housing sleeve 30.

With an external attachment there is no need for a locked release mode. Rings 50 of the internal attachment are, therefore absent and the external attachment always operates in the relatchable mode.

The bottom shoulder 60 of the guide post top is shown as is the chamfered 45° top edge 78.

As with FIG. 3, rocking trigger dogs 31 could be replaced by lock pins similar to lock pins 38 with groove 29 having a similar profile to groove 17.

It will be appreciated that, in both the internal attachment of FIG. 3 and the external attachment of FIG. 4, there will be a number of lock pins 38, trigger dogs 31 (or lock pins), reset spring 33, and bias springs 42 spaced around the attachments. There may be, for example 4, 6 or 8. In the internal attachment of FIG. 3, outer housing sleeve 35 can be quite firmly connected to the outer parts; in the external attachment of FIG. 4, housing outer sleeve 57 may require tie pins 100 to hold it. These tie pins 100 may alternate around the circumference of the attachment with lock pins 38. The circled insert of FIG. 4 shows one such tie pin 100. The tie pins 100 anchor the housing outer sleeve 57 to inner housing sleeve 30.

The top of line sleeve 30 is of the same profile as guide post top 12 and has the same load groove and lock groove as the guide post top. The external attachment of FIG. 4 could thus be gripped by a further external attachment, if required, although this would require guide line 24 to be cut first.

In operation, the external attachment is run, landed and locked in a manner analogous to FIG. 3. The guide line is run until the attachment passes over the guide post top 12. Although springs 39 of lock pins 38 are tending to force them inwardly, they will be pushed outwardly as they pass over the guide post top until they reach the level of lock grooves 17 when they will move into the groove. At this point the lower housing profile sleeve will have abutted against bottom shoulder 60 of the guide post top so that the attachment cannot move further downward. A shoulder of inner housing sleeve 30 will also be up against the chamfered edge 78 of the guide post top. These two abutments will ensure that the guide post top takes the weight of the attachment. It will ensure that the guide post top takes any shock resulting from accidental pressure on or striking of the attachment by subsea modules (e.g. a BOP stack or well tree) thereby minimising the risk of damage to the more delicate points of the attachment, such as the trigger dogs and lock pins.

As in FIG. 3, lock pins 38 and the 90° top profile of lock groove 17 prevent all parts of the attachment from moving upwardly except guide line 24 and inner sleeve 25. An upward pull on the guide line will thus move latch sleeve 54 upward forcing load ring 26 into load groove 16. When groove 29 of inner sleeve extension 25A reach the tops of trigger dogs 31, springs 41 push the top of the dogs into groove 29 and also the bottoms of the dogs into groove 37 of trigger sleeve 36.

Again, positive action is required to release the attachment. The action is identical with that of the internal attachment of FIG. 3; viz upward or downward movement of trigger sleeve 36 to withdraw lock pins 38 from lock groove 17 and rock trigger dogs 31 to free them from groove 29. Upward movement compresses upper bias spring 42A; downward movement compresses lower bias spring 42B. Again, an upward pull on the guide line 24 means that compressed reset springs 33 move inner housing sleeve 30 up relative to line sleeve 25 so that the tops of trigger dogs 31 pass above groove 29 and load ring 26 is freed. With release of pressure on trigger sleeve 36, the sleeve returns to its neutral position. Continuing the pull on guide line 24 will take the external attachment clear of the guide post top in the relatchable mode so that it can, if required, be transferred to another guide post top and latched onto that.

Figure 5:
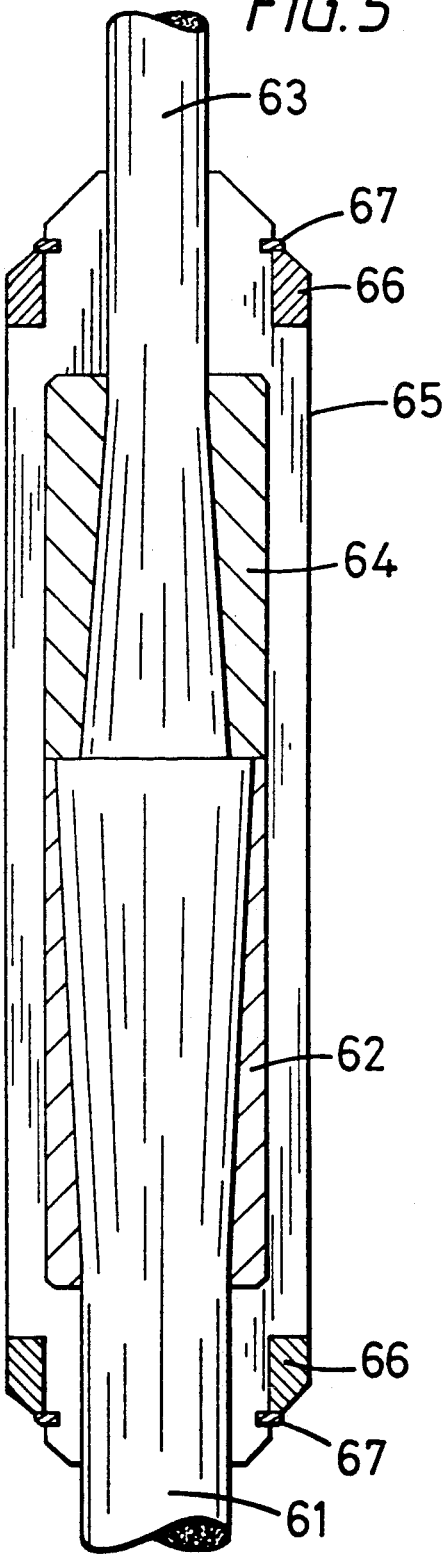
FIG. 5 is an elevation of a tie joint for joining guide lines of differing diameters.

As indicated in the preamble, the guide line attachments of the present invention and the constant diameter bore of the associated guide posts allow heavy duty guide line to be used with the attachments for, say, up to 100 feet from the attachment. FIG. 5 shows a simple tie joint for joining the heavy duty guide line to a more conventional size guide line to form a composite guide line. As previously indicated, a composite guide line is the subject of a separate UK Patent Application No. 0013118.6, entitled Composite Guide Line, and filed simultaneously with this application, so FIG. 5 is included within this application for the purpose of illustration only.

In FIG. 5, large diameter, e.g. 32 mm (1¼ inch) guide line 61 from an attachment has its end enclosed in a babbit housing 62. Smaller 20 mm (¾ inch) or 18 mm (⅝ inch) guide line 63 also has its end in a babbit housing 64. The two ends and housings are enclosed by a longitudinally split two-part housing 65, the two parts being held at each end by closure rings 66 and circlip stops 67.

The important feature of the tie joint of FIG. 5 is the relatively small overall diameter which will not impede the passage of an attachment release tool (see FIG. 7) down the guide line.

FIG. 6 shows two superimposed guide posts and an internal attachment passing through them. As indicated in the preamble, there may be up to three such superimposed guide posts on a sub sea installation.

FIG. 6 shows a lower guide post 13 attached to a permanent guide base 68. It has a constant diameter liner 14 and a guide post top 12 with closure segment 20, as already described with reference to FIGS. 1 and 2.

Superimposed on guide post 13 is a further guide post 69, which could be a guide post for a well tree or a BOP frame. Its bottom half 70 is of an internal diameter to fit over guide post 13. It has a funnel-shaped end for guidance and a conventional guide line gate 71. Top half 70 has a window 72 just above the level of guide post top 12 so that a ROV tool can have access to the guide post top.

The upper half of guide post 69 is similar to guide post 13, with liner 14 and guide post top 12 with closure segment 20. The guide line slot 73 which the segment 20 closes at the level of the guide post top is also shown.

FIG. 6 shows a guide line 24 with internal attachment 74 and sinker bar 27 (as described in FIG. 3) passing down through liner 14 of upper guide post 13 and just about to enter lower guide post top 12. Although lock pins 38 of the attachment (see FIG. 3) are being forced out by springs 39, internal attachment 74 will not lock into the upper guide post top lock groove 19 or load groove 18 because of the angled slope of the lower parts of these grooves. So long as there is a downward force, the attachment will pass through any number of guide post tops. When it reaches the guide post top to which it is required to be locked, however it is run until lock pins 38 are on a level with or past lock groove 19. It can, indeed, be run until it stops so that accurate positioning is not required. Then if an upward pull is substituted for downward movement, lock pins 38 will lock against the first 90° top profile of lock groove 19 of the lowest guide post top.

Release can be affected as already described with reference to FIG. 3.

Figure 7:
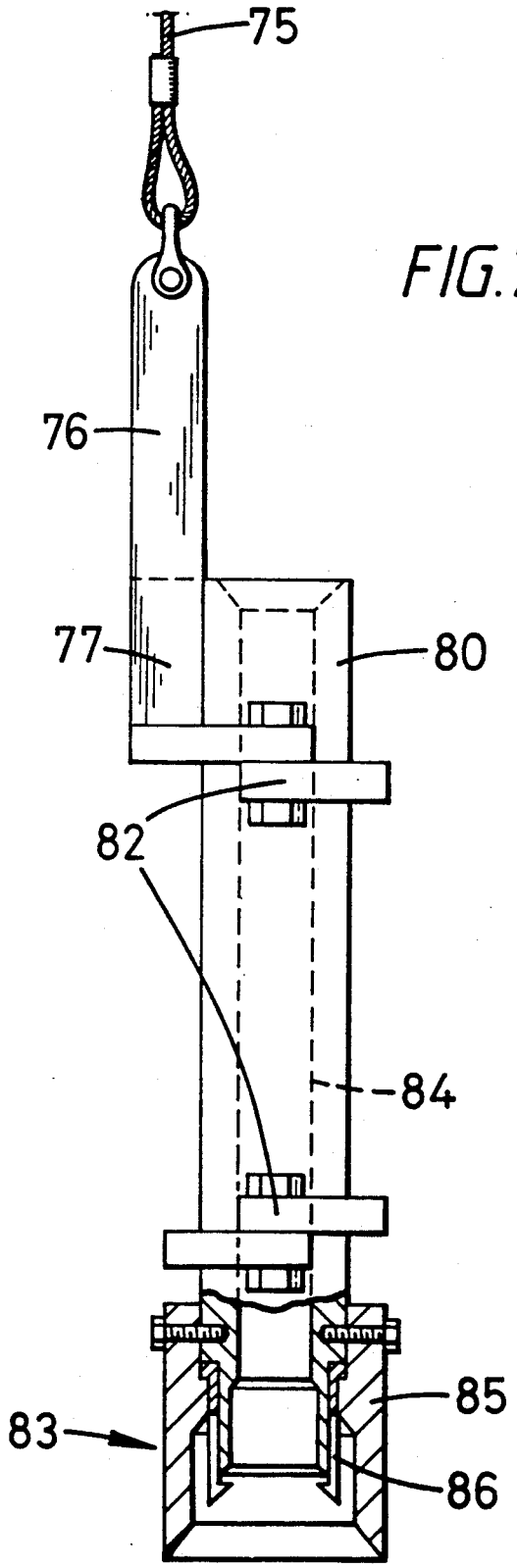
FIG. 7 is an elevation of a release tool utilising a dropped weight.

As previously explained with reference to FIGS. 3 and 4, one of the methods of release of an attachment is by downward pressure on trigger sleeve 36 using a weight. FIG. 7 shows a weighted release tool.

In FIG. 7, the tool can be deployed and lowered around the guide line of the attachment to be released by a winch line 75 and hanging aligner 76 or, alternatively, on drill pipe, attached by drill pipe box 77. Weight housing 80 is designed and made of suitable metal to provide an adequate weight for the tool. Housing 80 is a split housing hinged by hinges 82 so that the release tool can be placed around the guide line in the moonpool of a surface vessel. If used as a weight release tool, latch mechanism 83 shown in FIG. 7 is absent. It will be noted that weight housing 80 has a central hollow core 84 of sufficiently large diameter to allow the tool to pass over a tie joint of the guide line as shown in FIG. 5.

The tool is lowered around the guide line until the bottom of housing 80 strikes the top of trigger sleeve 36 of the attachment to be released forcing the sleeve down and is held there until the release sequence as previously described has been effected and the attachment is pulled free by the guide line tension.

The release tool of FIG. 7 can also be adapted to give an upward pull on trigger sleeve 36, with latch mechanism 83 attached to the bottom of housing 80. Latch mechanism 83 has split guides 85 and split collets 86. The guides 85 guide the tool over the top of the attachment to be released and the collets 86 are of a shape such that they can spring into latch profile 51 at the top of trigger sleeve 36. Two styles of latch mechanism 83 can be designed so that the collets 86 are of a length and shape to latch onto the trigger sleeves of an internal or external attachment, respectively.

Figure 8B:
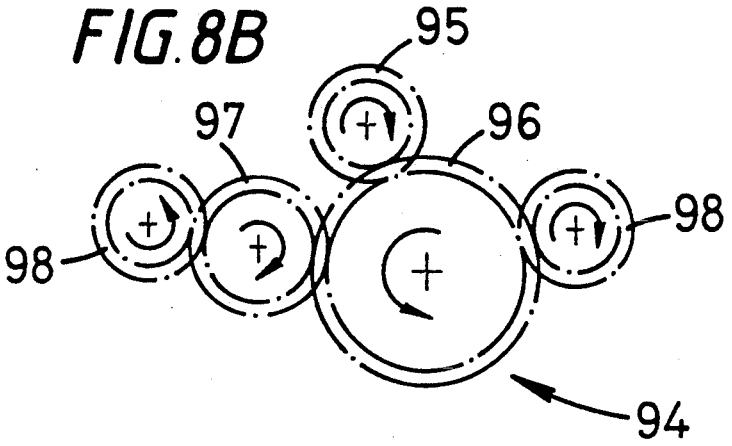
FIGS. 8A, 8B and 9A, 9B are, respectively, sectioned elevations and sectioned plans of an ROV release tool, and FIGS. 10A–10H and 11A–11E compare, diagrammatically, the sequence of operations required, in present practices using existing attachments with the streamlined operations available with attachments of the present invention.
Figure 8A:
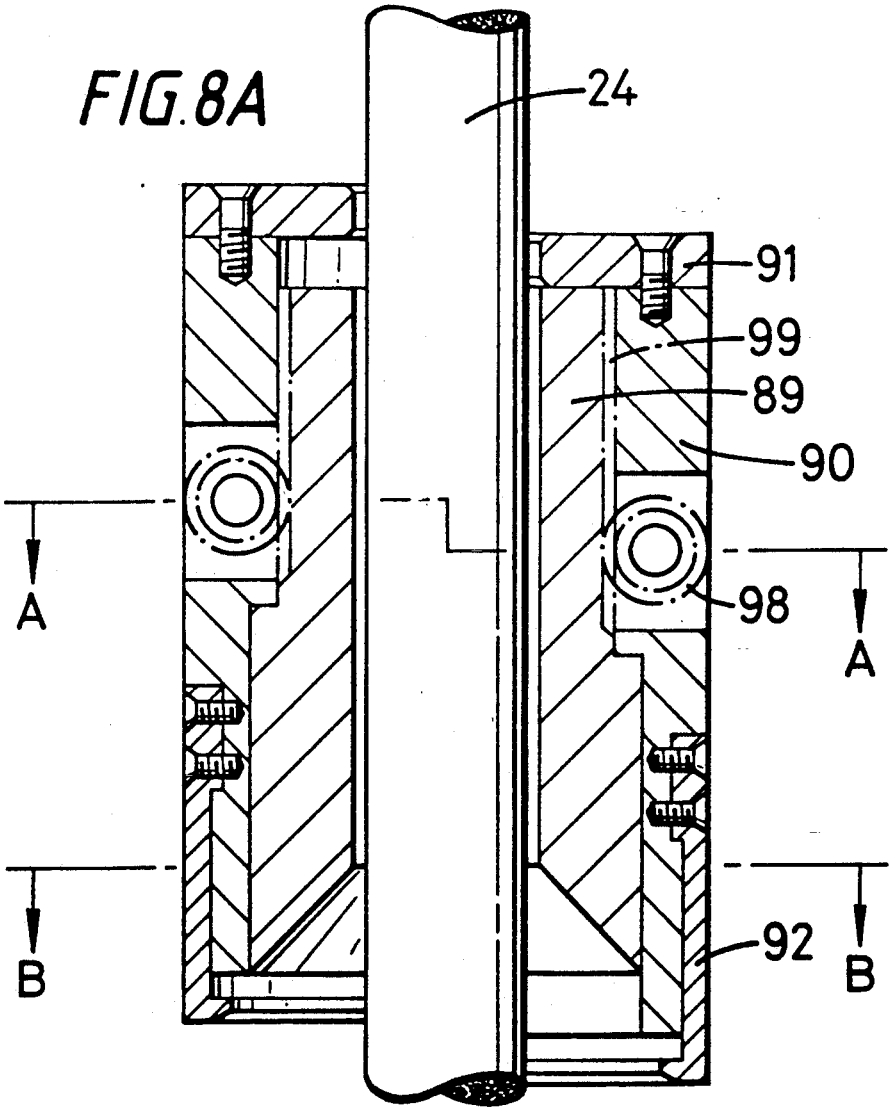
Figure 9A:
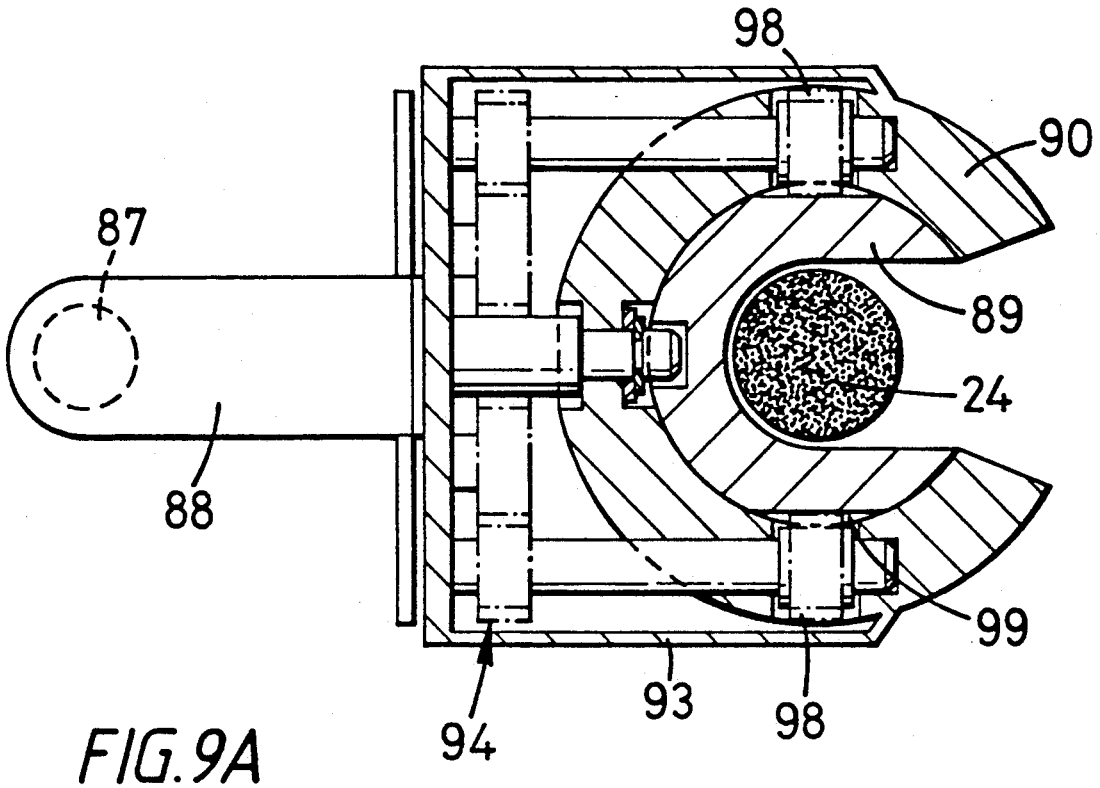
Figure 9B:
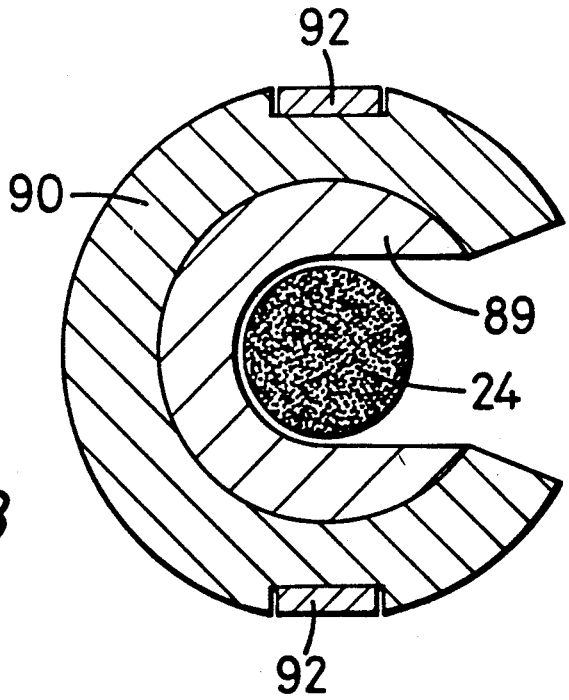

Movement of trigger sleeve 36 can also be effected by a release tool attached to and controlled by a manipulator arm of a ROV. FIG. 8A is a sectioned elevation of such a tool and FIG. 8B a diagrammatic view of the gear assembly of such a tool. FIGS. 9A and 9B are sectioned plans of the tool along, respectively, lines A—A and B—B of FIG. 8A.

In FIGS. 8A and 8B and 9A and 9B, the release tool has a rotatable handle 87 suitable for an ROV, with a shaft 88 manipulator. The ROV brings the tool to a point just above the attachment to be released, if necessary, passing it through a window 72 (see FIG. 6) of a guide post above the attachment to be released. U-shaped sleeve 89 abuts guide line 24 just above the attachment and provides an anti-torque reaction.

Surrounding the sleeve 89 is a housing 90 with a cap 91 screwed to its top and two latch clips 92 screwed to its bottom. A further outer housing 93 between rotatable handle shaft 88 and main housing 90 encloses a gear drive assembly 94. This assembly has a drive gear 95 driven by rotatable handle shaft 88 which drives through a large idle gear 96 and a small idle gear 97, two pinion gears 98 in housing 90. Pinion gears 98 mesh with rack teeth 99 on sleeve 89. There are suitable bearings and connecting shafts as appropriate so that the overall effect of rotating handle shaft 88 by rotation of the ROV manipulator is to rotate pinion gears 98 and so move housing 90 up and down relative to sleeve 89. FIG. 8A shows this relative movement, the left and right hand sides showing respectively the limits of this movement.

Latch clips 92, will spring apart and grip latch profile 51 of trigger sleeve 36, when the tool is moved into place by sliding down guide line 24, so movement of housing 90 will also move trigger sleeve 36. Theoretically downward movement would be possible but the tool would have to be held down. In practice, therefore, the tool and gear assembly will be designed to pull trigger sleeve 36 upward against the reaction forces previously described.

The release will be affected as previously described with reference to FIGS. 3 or 4 and once the attachment has been released, the tool can be withdrawn by the ROV by simply moving it horizontally sideways to free latch clips 92 from the latch profile 51 of trigger sleeve 36 and the sleeve 89 of the tool from guide line 24.

FIGS. 10A-10H and 11A-11E show, reading from left to right, the sequence of operations necessary for a workover of a sub sea installation using existing attachment devices (FIGS. 10A-10H) and the much simpler sequence (FIGS. 11A-11E) available with attachments according to the present invention.

Figures 10A, 10B, 10C, 10D, 10E, 10F, 10G, 10H:
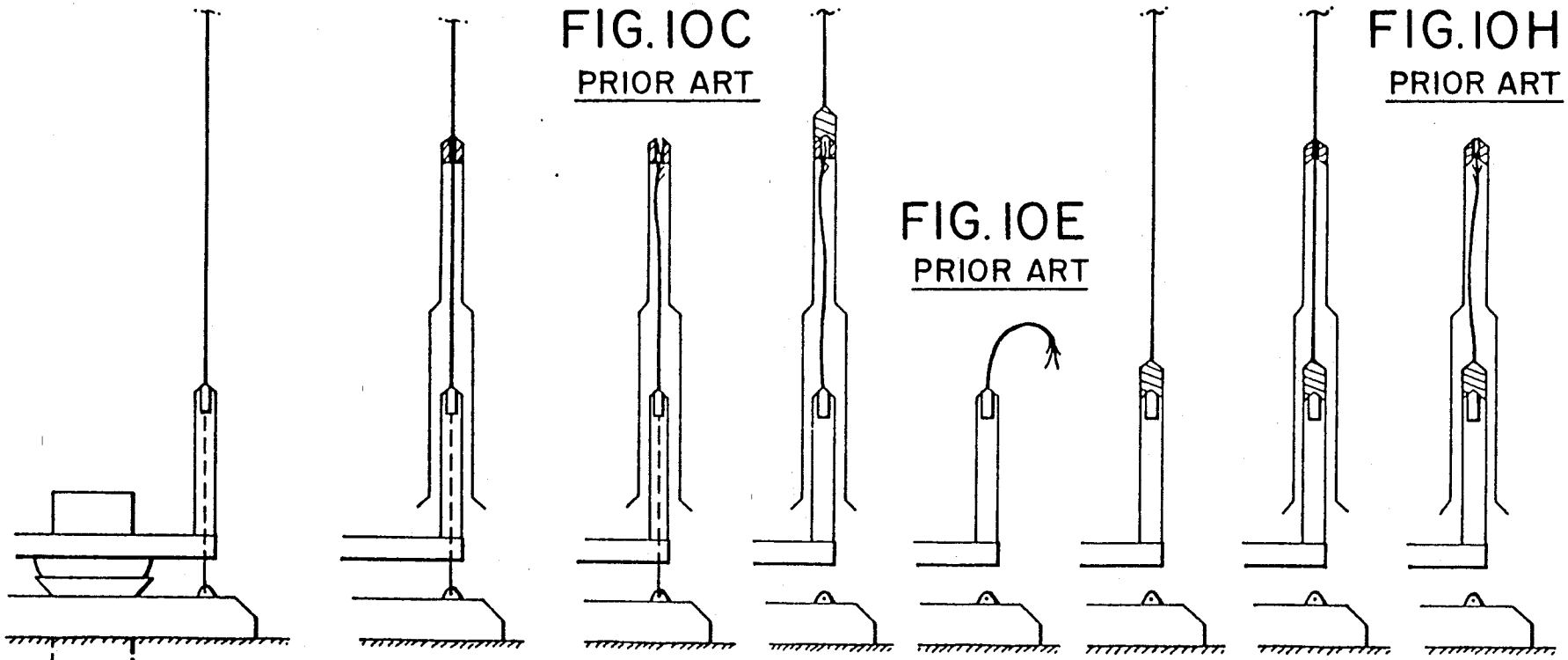
FIG. 10A PRIOR ART
FIG. 10B PRIOR ART
FIG. 10C PRIOR ART
FIG. 10D PRIOR ART
FIG. 10E PRIOR ART
FIG. 10F PRIOR ART
FIG. 10G PRIOR ART
FIG. 10H PRIOR ART

In FIGS. 10A-10H, a permanent guide base is shown lowered onto a well head with guide lines attached to guide post tops (FIG. 10A). A further module (e.g. a tree frame on BOP frame) can be lowered and placed on top of the permanent guide base (FIG. 10B). However, for production when the tree is left in place, the guide lines have to be removed by cutting them at the level of the upper guide post tops leaving tails inside the posts (FIG. 10C).

If, for a workover, in which BOP or tree frame has to be removed, fresh guide lines have to be run and attached to the upper guide post tops for running the tree frame retrieving tool (FIG. 10D). After retrieving the frame, the cut guide line tails have to be freed and removed from the permanent guide base posts (FIG. 10E). Fresh guide lines then have to be run and reaffixed to the permanent guide base post (FIG. 10F) before the BOP can be re-run and returned into the permanent guide base. On completion of the work over, the tree frame is re-run (FIG. 10G). The guide lines then have to be cut once more to at the top of the production module (FIG. 10H).

Figures 11A, 11B, 11C, 11D, 11E:
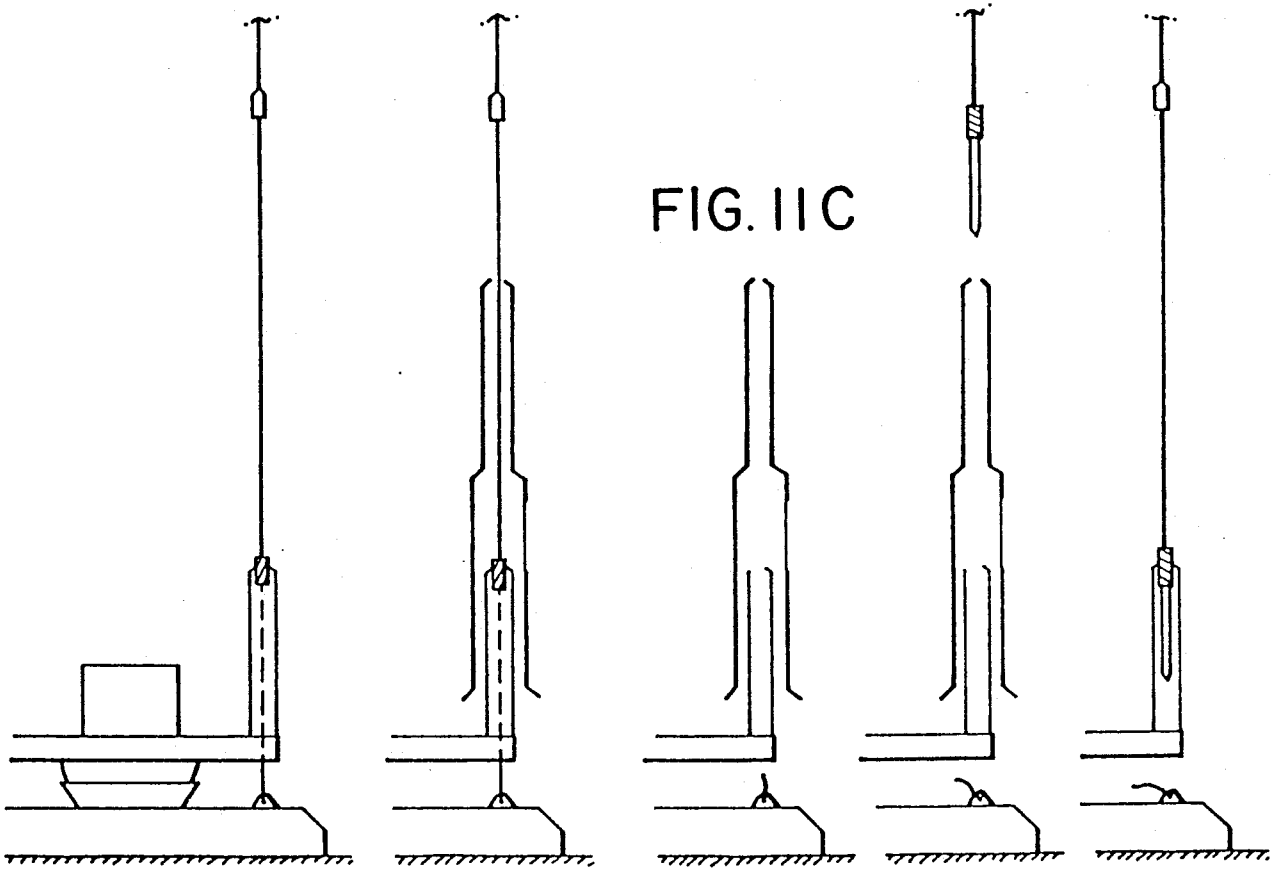

By contrast, in FIG. 11, a much simpler sequence of operations is possible. A permanent guide base is run and landed using guide lines having internal attachments (FIG. 11A) and a BOP or tree frame is lowered down these lines onto the permanent guide base (FIG. 11B). For production, the guide lines can simply be released by a ROV operating through the windows of the guide posts of the upper frame. If the attachments have been set in the locked release mode, then the guide lines can be drawn up without relatching onto the guide post tops of the upper frame (FIG. 11C). For a workover all that is required is the lowering of an attachment and its automatic latching onto the appropriate module (FIGS. 11D and 11E) as already described with reference to previous figures. No cutting and removal of old guide lines is required.

In both FIGS. 10A-10H and 11A-11E, the sub sea installation is shown with a mud mat or temporary guide base on the sea floor, with the permanent guide base above the mat or temporary base. Guide lines are shown by dotted lines connecting the mat or temporary base to the permanent guide base tops, as these lines have been used for the placement of the permanent guide base,.

In many circumstances, mud mats or temporary guide bases do not have to be used. If they are used, the guide lines between the mud mats or temporary guide base and the permanent guide base may have to be cut whatever type of attachments are used, and such cut guide lines are shown in the later stages of the operating sequence of both FIGS. 10A-10H and 11A-11E.

I claim:

1. A guide line attachment for attaching a guide line to a guide post or other portion of a sub-sea installation comprising (a) three concentric sleeves surrounding the end of a guide line, each sleeve being capable of relative movement along the axis of the guide line, (b) springs between and stops on the sleeves to control the relative movement, (c) means actuated by relative movement of the sleeves to lock the attachment into a guide post top or other part, and (d) a latch to releasably lock the sleeves when the guide line is tensioned and prevent relative axial movement of the sleeves.

2. A guide line attachment as claimed in claim 1 wherein the attachment attaches to the inside of a guide post to or other portion, the attachment having a maximum outside diameter less than that of the internal diameter of the guide post top.

3. A guide line attachment as claimed in claim 1 wherein the attachment attaches to the outside of a guide post top or other portion, the sleeves extending beyond the end of the guide line to form a hollow assembly adapted to fit over the guide post top or other portion.

4. A guide line attachment as claimed in claim 1 having means which can be preset before use to give operation in either a locked release mode or a relatchable mode.

5. A guide line attachment as claimed in claim 4 wherein the means is a ring in one of the sleeves near its top end, the ring being an outwardly biassed spring ring for the locked release mode or an insert ring for the relatchable mode.

6. A guide line attachment as claimed in claim 1 wherein the attachment is locked to a guide post top or other portion by an upward pull on the guide line, the guide line being fixed to the innermost of the three concentric sleeves which moves up with the guide line relative to the other sleeves to lock the attachment to the guide post top or other portion and to engage the latch for locking the sleeves.

7. A guide line attachment as claimed in claim 1 wherein the attachment is released from a guide post top or other portion by upward or downward movement of one of the outer concentric sleeves which unlocks the attachment locking means and releases the sleeve locking latch.

8. A guide post top for use with a guide line attachment according to claim 1 having an internal load groove for engaging the attachment locking means having angled top and bottom edges and an internal lock groove having an angled bottom edge and a horizontal top edge.

9. A guide post top for use with a guide line attachment according to claim 1 having an internal load groove for engaging the attachment locking means having angled top and bottom edges and an external lock groove having an angled bottom edge and a horizontal top edge.

10. A guide post top as claimed in claim 8 having a guide line slot and a segment having a lock screw to close the slot.

11. A release tool for use in association with a guide line attachment as claimed in claim 7, which is a weighted tool adapted to be lowered to the sub sea installation to strike the outer concentric sleeve used for release of the attachment and move it down having, optionally, a latch mechanism to grasp the outer concentric sleeve and move it upwardly.

12. A release tool for use in association with a guide line attachment as claimed in claim 7 which is a tool adapted to be actuated by a ROV having latch clips for engaging the outer concentric sleeve used for release at the attachment and mechanical gearing driven by the ROV to move the sleeve upwardly.

* * * * *

UNITED STATES PATENT AND TRADEMARK OFFICE

CERTIFICATE OF CORRECTION

PATENT NO. : 5,107,930

DATED : April 28, 1992

INVENTOR(S) : Hans P. Hopper

It is certified that error appears in the above-indentified patent and that said Letters Patent is hereby corrected as shown below:

Column 1, line 36 - delete "seal" and substitute therefore --sea--

Column 8, line 13 - insert -- 51 -- following "profile".

Column 14, line 14 - delete "internal" and substitute therefore -- external --.

Signed and Sealed this

Eleventh Day of October, 1994

*Attest:*

Bruce Lehman

BRUCE LEHMAN

*Attesting Officer*

*Commissioner of Patents and Trademarks*